US005206457A

United States Patent [19]

Pascal et al.

[11] Patent Number: 5,206,457

[45] Date of Patent: Apr. 27, 1993

[54] PYROTECHNIC CHAIN IGNITER FOR CARGO WARHEAD SUBMUNITION

[75] Inventors: Alain R. Pascal, Saint-Eloy de Gy; Patrice H. Chemiere; Jean-Paul A. Dupuy, both of Bourges, all of both of Bourges, all of France

[73] Assignee: GIAT Industries, France

[21] Appl. No.: 559,097

[22] Filed: Jul. 30, 1990

[30] Foreign Application Priority Data

Aug. 1, 1989 [FR] France ..... 89 10338

[51] Int. Cl.[5] ..... F42C 15/184

[52] U.S. Cl. ..... 102/235; 102/251

[58] Field of Search ..... 102/233, 235, 245, 251, 102/234, 254, 256, 231, 272, 236, 244, 269

[56] References Cited

U.S. PATENT DOCUMENTS

| | | | |
|---|---|---|---|
| 1,563,418 | 12/1925 | Adelman | 102/245 |
| 3,848,531 | 11/1974 | Mellen | 102/245 |
| 4,488,488 | 12/1984 | Looger et al. | 102/396 |
| 4,612,858 | 9/1986 | Backstein et al. | 102/245 |
| 4,811,664 | 3/1989 | Levy et al. | 102/269 |

FOREIGN PATENT DOCUMENTS

| | | | |
|---|---|---|---|
| 328749 | 4/1919 | Fed. Rep. of Germany | 102/246 |
| 1121878 | 6/1963 | France | 102/251 |
| 220649 | 5/1968 | Sweden | 102/245 |

*Primary Examiner*—Stephen M. Johnson

*Attorney, Agent, or Firm*—Parkhurst, Wendel & Rossi

[57] ABSTRACT

A pyrotechnic chain igniter device for cargo warhead submunition including an explosive charge contained in an enclosure, which includes a striker mobile in a longitudinal bore for striking a primer, a slider carrying the primer, wherein the slider is slidable between a safety position and an armed position. The safety position is defined by the primer being mis-aligned with the striker and the armed position is defined by the primer being substantially aligned with the striker. The device also includes at least one means for blocking the slider in the safety position and a neutralization means including a trigger actuated by a driving means for preventing the slider to slide into the armed position. Further, the device includes a delayed self-destruct means including a second primer, a delay wick, igniter and a second striker, wherein the second striker is mounted on the slider for initiation of the second primer, the second primer being cooperable with the delay wick and igniter relay to initiate the primer.

8 Claims, 10 Drawing Sheets

PYROTECHNIC CHAIN IGNITER FOR CARGO WARHEAD SUBMUNITION

BACKGROUND OF THE INVENTION AND PRIOR ART

The field of the present invention is that of igniters for cargo warhead submunitions, and in particular for antipersonnel and antivehicle grenades dropped in large numbers from above a target, according to the "saturation" technique. A cargo warhead is a warhead in which the usual explosive charge has been replaced by a large number of submunitions or subprojectiles.

In most cases, the submunitions are grenades consisting of a cylindrical fragmentation body having an antipersonnel effect by projection of shrapnel, and enclosed at one end by a shaped charge cover to permit the charge to penetrate light or weakly armed vehicles through the roof. The other end of the body supports the igniter device that initiates the explosive charge contained in the body.

Ordinarily, these grenades are stacked in several columns inside the cargo warhead, with the igniter device turned toward the base occupying the space left free by the shaped charge cover of the next grenade, or is fitted into a form arranged for this purpose in the base of the cargo warhead.

The grenades are then ejected and dispersed over the warhead trajectory in a dumping phase, with a speed of rotation about their axis that is close to that of the warhead at the time of dumping.

The main technical function of the igniter device is to ignite the main charge primer of the submunition as reliably as possible at the time of its impact and to prohibit this ignition in cases of low impacts occurring during handling.

The igniter device may also include a specific neutralizing device, i.e. one that prohibits any ignition from normal handling.

The constraints to be complied with in solving the technical problem defined above are as follows:

There is a form and dimensional constraint. This constraint stems from the need to fit the ignition device into the shaped charge cone of the following submunition, as explained above.

There is then a weight constraint. The igniter device on the rear of the submunition must be as light as possible so that the submunition center of gravity is located as far forward as possible, which favors stability along the trajectory.

Finally, there is a constraint related to the cargo warhead firing conditions, which is essentially the need to withstand ignition from the very high acceleration when dropped.

The U.S. Pat. No. 4,488,488, WO8603828, EPO256320, U.S. Pat. No. 4,612,858 and FR2606136 describe various solutions for igniter devices of this type. Ordinarily, the igniter devices described in these patents include igniters consisting of a primer, which a striker, under the effect of its own inertia, strikes at the time of impact.

The reliability of ignition may be complemented by a self-destruct system that is triggered independently of the main igniter, and which causes the submunition to self-destruct by igniting the main charge after a certain delay.

The prevention of ignition in case of impact or handling is ensured by locks, which are raised only consecutive to a rapid rotation of the submunition. The example of construction closest to the present invention is the third version of the igniter device described in U.S. Pat. No. 4,612,858.

Ordinarily, this igniter device includes a primer arranged in a slider, which a striker strikes at the time of impact, moved by its own inertia. The reliability of the ignition is complemented by a self-destruct mechanism whose ignition is caused by the rotation of the subprojectile.

The prohibition of ignition during simple handling or impacts therefrom stems from the face that, in storage position, the slider is in such a position that the primer it carries is not in alignment with the rest of the pyrotechnic chain, and is held in this position by the striker as long as the striker is not in armed position.

This same spring neutralizes the igniter system by placing the slider in a disaligned, locked position if the speed of rotation is inadequate or if the striker does not operate after impact.

The self-destruct system includes a primer integral with the slider and which, under the effect of the centrifugal force, strikes a striker integral with the body of the igniter device. This primer in turn initiates a retarding composition arranged in a groove in the face of a disk placed between the initiation system and the main charge, and presenting an igniter relay in the striker axis that can be initiated either by the main primer or by the retarding composition.

A lateral opening in the primer housing aligns with the retarding composition, allowing its initiation.

This device exhibits numerous disadvantages. It may first be noted that all of the operating safeties are raised under the action of the centrifugal force alone, which is harmful from the point of view of safety.

With respect to the self-destruct device, it can be said that the procedure for loading the retarding composition is not easy. It is difficult to obtain a homogeneous composition, which is necessary for good regularity of combustion and consequently of the delays, which should be reproducible from one igniter device to the next.

It will also be difficult to vary these delays, as the combustion time is directly dependent on the length of the charge, except by modifying this length and therefore the disk, or changing the composition.

Nor is there found in this device any way of interrupting the pyrotechnic chain between the igniter relay and the retarding composition, which is a sensitive element, and this is a serious safety concern.

When the slider carrying the primer is pinched in an intermediate position without the self-destruct device being initiated, the slider will not be in neutralization position, and an accidental initiation is then possible consecutive to manual handling of the grenade after it has fallen on the ground.

Finally, this igniter device consists of a large number of parts, which makes it expensive. In particular, the body is a complex piece of foundry work that is generally made of a zinc alloy, and it provides both the housing for the various parts as well as the attachment and securing of the igniter device on the submunition body.

GENERAL DESCRIPTION OF THE INVENTION

Compared with the construction described above, the present invention concerns an igniter device which, by its design and construction, offers enhanced safety with a reduced number of mechanical parts, while satisfying the constraints related to this type of device, and which were explained above. It also relates to an igniter device including self-destruct means that are more reliable and can be removed, and reliable neutralization means.

The pyrotechnic chain igniter device for cargo warhead submunition including an explosive charge contained in an enclosure according to the invention includes:

A slider carrying a primer. The slider is mobile in a transverse groove of a body, between a safety position in which the primer is not aligned with the rest of the pyrotechnic chain and an armed position in which it is aligned.

A mobile striker in a longitudinal bore, which strikes the primer when the submunition impacts with the ground;

At least one means for locking the slider in its safety position.

The igniter device further includes neutralization means including an obstacle which, actuated by driving means, places itself in the path of the slider if the slider has not adopted its armed position after the submunition has fallen on the ground, for the purpose of preventing any later passage of the slider to its armed position.

This construction has the advantage of blocking the slider in a known position and preventing the firing of the main pyrotechnic chain, and also the firing of any delay chain.

This is because, in the system proposed by the prior art, the neutralization device requires a movement of the slider that will bring the slider into a neutralization position. This is a motion that cannot occur if the slider is blocked.

By placing a mechanical obstacle in the path of the slider, the device proposed by the invention provides such a neutralization regardless of the state of the springs actuating the slider.

In one preferred embodiment, the neutralization means include a trigger mounted pivoting relative to the body and held by a spring, constituting the driving means, in a position such that one of its ends, constituting the obstacle, prevents any passage of the slider to its armed position, the trigger being fixed ready to flip against the action of the spring under the effect of an axial rotational motion of the submunition, in which case its extremity no longer prohibits the motions of the slider.

Such a device avoids the storage of energy inside the device, as the spring is not held in stretched position within the device and is stretched only when the submunition is rotated, which decreases the risk of degrading the spring during storage.

In one variant, the device according to the invention includes a delayed self-destruct means consisting of a second primer, a delay wick, an igniter relay and a striker mounted on the slider.

Such a variant provides a delay of easy design since the wick is made independently of the igniter device.

According to other characteristics:

the primer is a percussion-sensitive inflamatory device and the delay wick is connected to this inflammatory device by a tube;

the self-destruct means includes two support pieces to click it onto the body, as this design facilitates the installation of the delayed self-destruct means on the igniter device body and also makes it possible to use wicks of different lengths with the same igniter device assembly;

the end of each trigger includes, opposite the striker carried by the slider, a hollow of a shape complementary to that of the striker itself, so that the striker is trapped if it enters the hollow;

The first slider blocking means includes three elements aligned along an axis YY' parallel to the longitudinal axis XX' of the submunition. One of the elements is a flyweight resting in a hollow in the body to block the slider. The second element is a spring guided on one side over a short distance by a pin fastened to the body, and adjusted on the other side in a bore in the flyweight. The third element is an opening arranged in the body all around the axis YY'.

It includes a second slider blocking means, which consists of a collar integral with the striker, over which a hollow in the slider comes to bear, and wherein the aerodynamic forces exerted on a tape integral with the striker translate the striker and release the slider, and wherein the collar, when the slider is immobilized in its safety position by the first blocking means, lodges in a groove in the slider which prevents any translation of the striker in its longitudinal bore.

The striker includes an axial bore closed by a washer, in which a rod slides, including at one of its ends a shoulder cooperating with the washer to extract the striker, the pulling motion being produced by the tape fastened to the free end of the rod.

A metal external mask having an internal shape that matches the external shape of the body. The metal mask is secured by crimping on a groove running around the charge enclosure, and the body being held in contact with the mask by a closure disk which itself presses against the load.

Other and further advantages and characteristics of the present invention will be understood in reading the following non-limitative description of embodiments taken in conjunction with the accompanying drawings.

Figure 1:
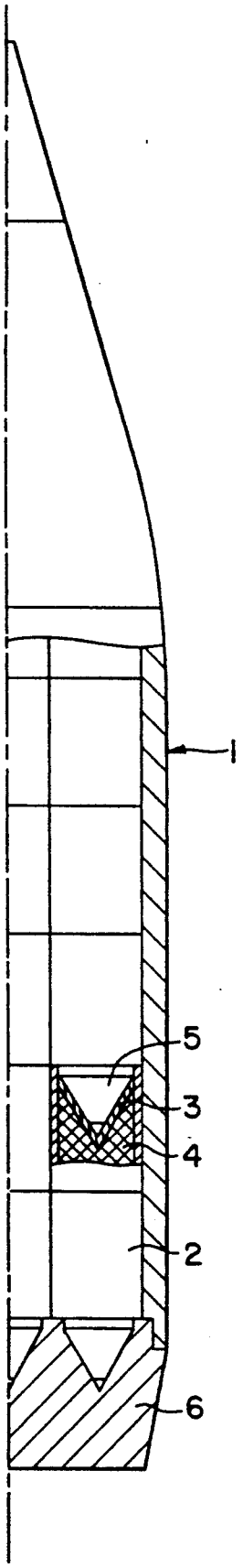
FIG. 1 is a sectional view of a cargo warhead.

The igniter system for cargo warhead submunitions 1 according to the invention is, as explained above, designed to be installed on submunitions 2, a large number of which are housed in this warhead. Each submunition is designed so that the igniter device of one fits into space left free within the cover of the shaped charge of the following submunition. This hollow is shown in detail in FIG. 1, illustrating shaped charge cover 3 of a submunition including an explosive charge 4, within which cover the igniter device 5 of the next submunition is fitted. This figure is intended to illustrate the classical arrangement of submunitions 2 in the warhead, with the igniter system oriented toward the base 6 of the warhead.

Figure 2:
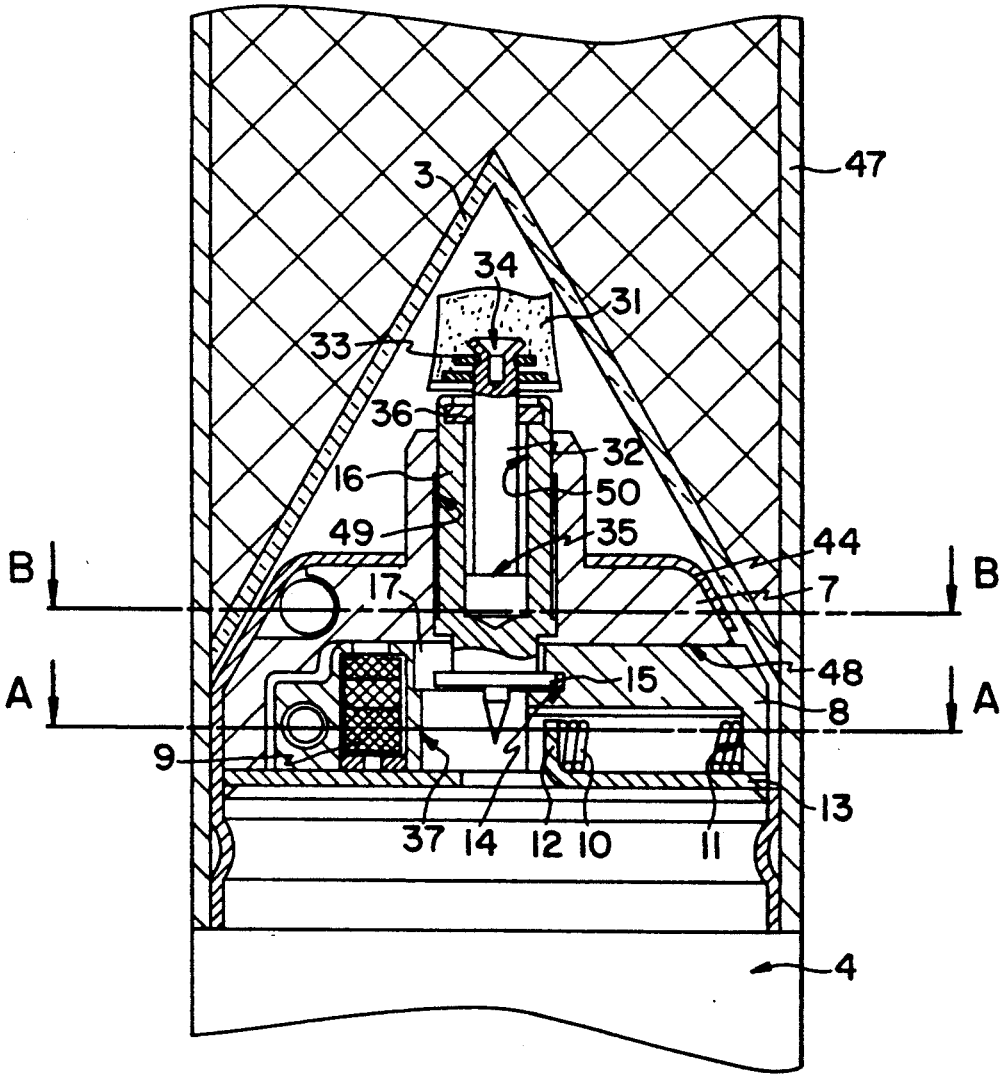
FIG. 2 is a partial longitudinal section of two submunitions in a stack, showing the igniter system according to the invention.

As shown in FIG. 2, the igniter device according to the invention, shown in its safety position, consists of a body 7 arranged inside a metal mask 44 made of stamped metal plate, and whose internal profile matches the external profile of the body 7.

The mask 44 thus covers the body 7, which supports all of the igniter means, the body being held in contact with the mask by a closure disk 13, itself coming to bear on the explosive charge 4.

Figure 7:
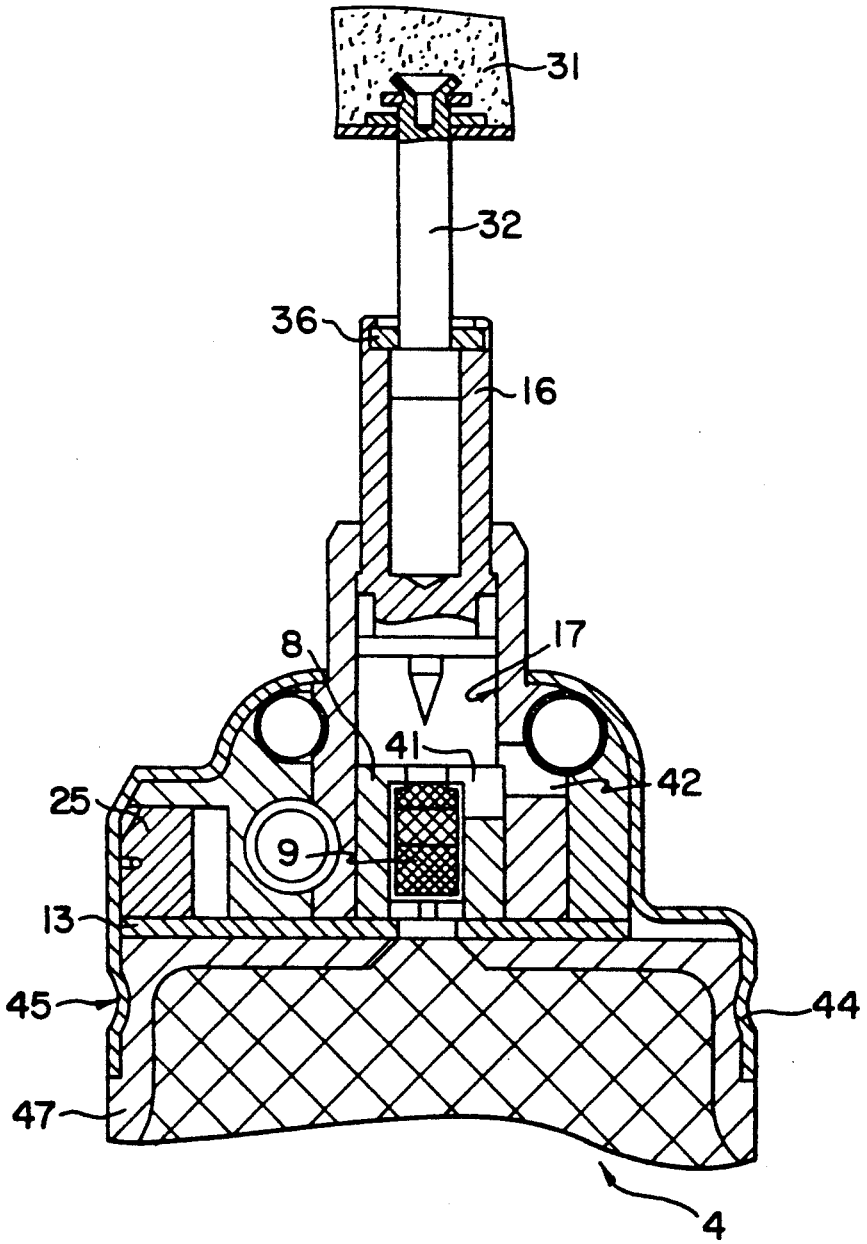
FIG. 7 is the same section as in FIG. 6, with the striker being in armed position.
Figure 8:
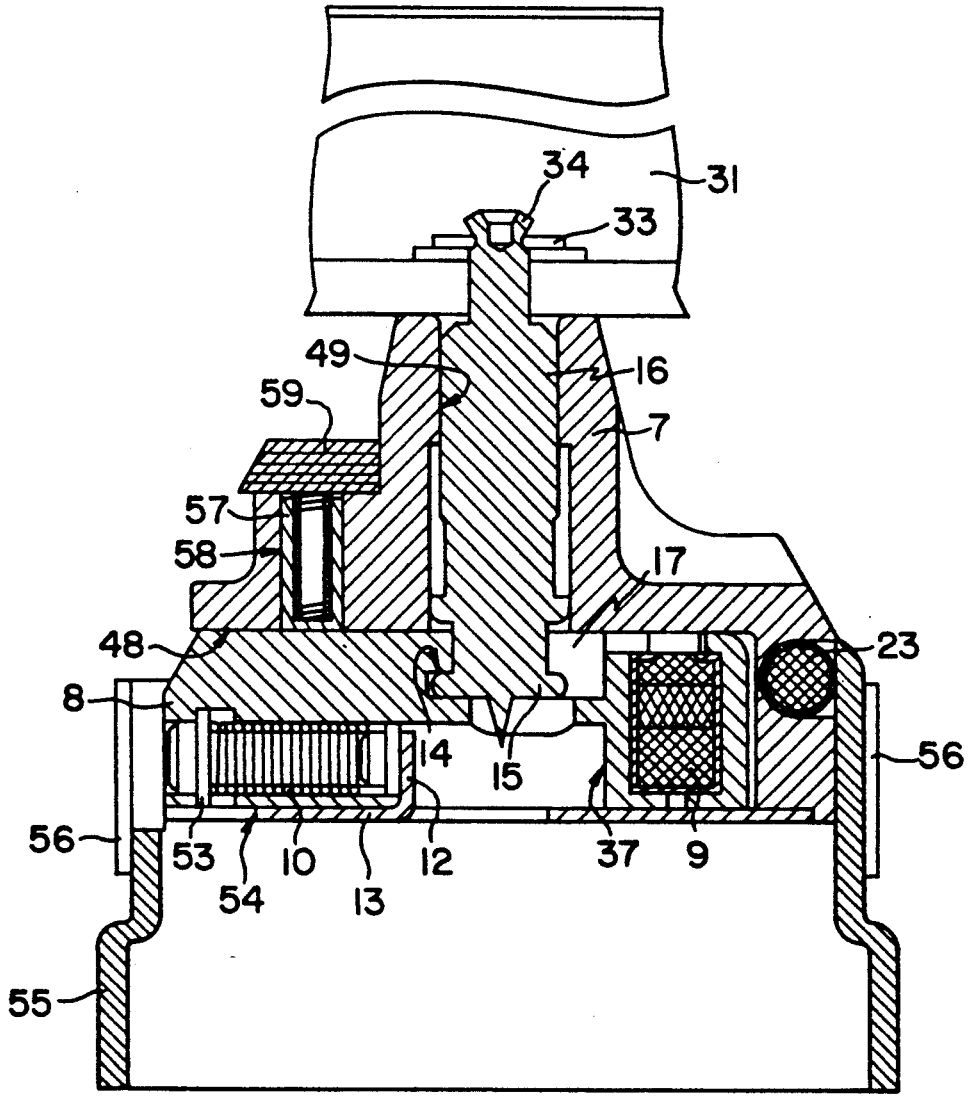
FIG. 8 is an axial section representing a second embodiment of the device along the plane D—D of FIG. 10.

The mask carrying the igniter device is integrated with the explosive charge by an annular crimping 45 around the metal enclosure 47 of the charge in FIG. 7, but any other mode of connection is possible. The mask constitutes a reinforcement of the body and allows the body to be dimensioned for the use of plastic materials. That is, the forces transmitted during the motions of the submunitions by pieces constituting the igniter device according to the invention will be absorbed by the mask, which is of sufficient rigidity. This avoids having to use a foundry piece of complex profile to manufacture the igniter device.

Inside the body 7 is provided a transverse groove 48 inside of which a slider 8, carrying a primer 9, is slidably mounted. The slider is pushed in its groove by a compression spring 10 bearing on one side against an extremity 11 of an opening provided in the slider, and on the other side on a peg 12 of the closure disk 13 of the body 7.

The body also includes a longitudinal bore 49 inside of which is slidably mounted a striker 16.

Striker 16 includes an axial bore 50 inside of which is arranged a telescoping rod 32 having a shoulder 35 that butts against washer 36, which is integral with the striker 16 by crimping.

A textile tape 31 is connected to the telescoping rod 32 by means of a washer 33 secured by crimping 34.

The striker also carries a collar 15 which, when the device is in safety position, fits into a groove 14 in the slider 8, thereby immobilizing the striker in translation.

Figure 4:
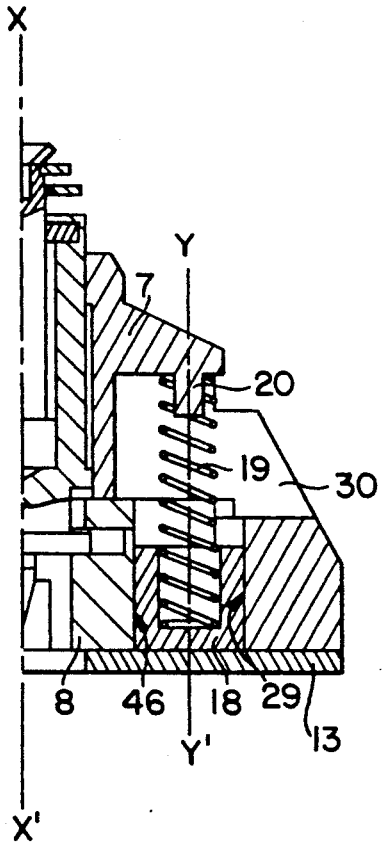
FIG. 4 is a section of the acceleration safety, taken along the plane E—E of FIG. 3.
Figure 3:
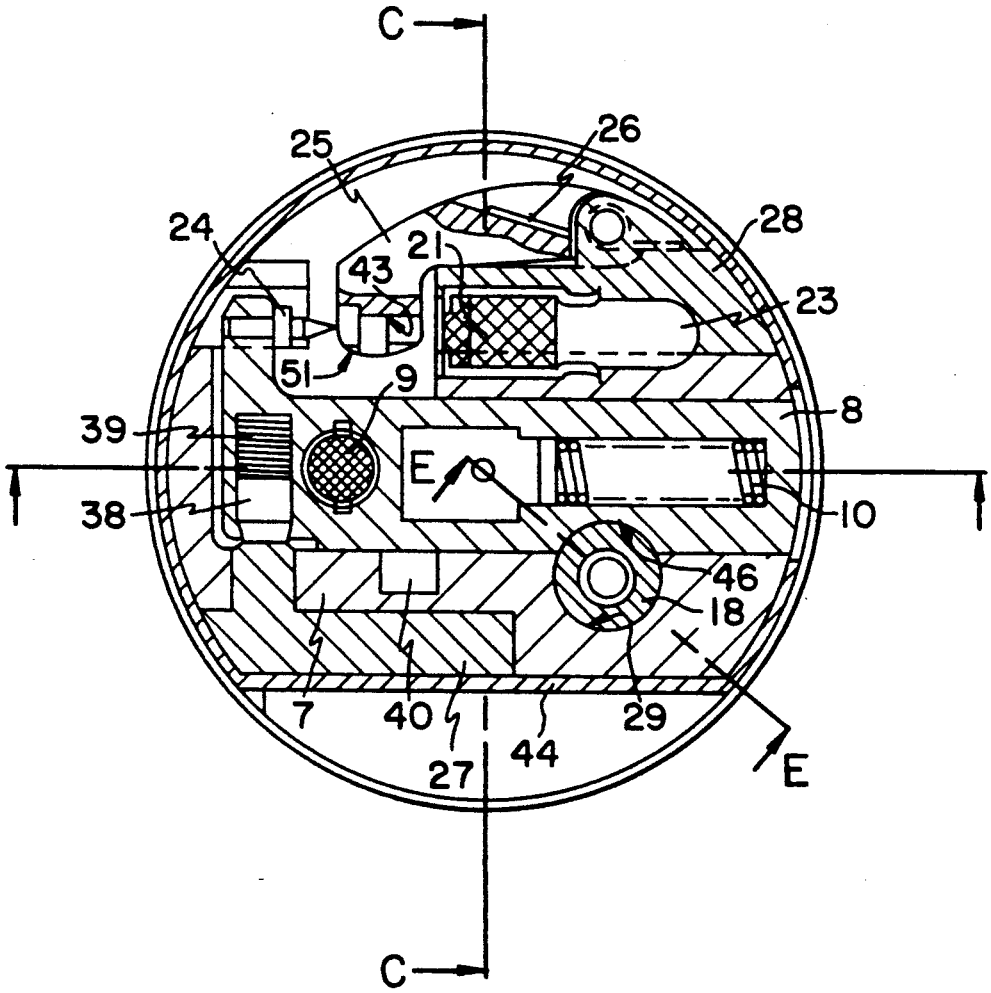
FIG. 3 shows a cross section of a first embodiment of the device, along with a plane A—A of FIG. 2.

FIGS. 3 and 4 show a first means of blocking, consisting of a flyweight 18 bearing in opening 29 in body 7, and on an imprint 46 arranged in the slider to block the slider (FIG. 3). The flyweight is held in position by a compression spring 19, adjusted on one side in a blind hole in flyweight 18 and guided on the other side over a short length by a pin 20 integral with the body 7.

In classical fashion, this lock is designed to unlock only in the presence of adequate accelerations and travel of the flyweight (acceleration of the order of 900 G), to prevent accidental unlocking due to normal handling or to dropping during the storage or handling periods.

It will be noted that the flyweight 18, spring 19 and pin 20 are aligned along a line Y—Y' parallel to the longitudinal axis X—X' of the submunition and to the acceleration vector of the projectile when the shot is fired. An opening 30 is arranged in the body 7 all around the line Y—Y' in FIG. 5, for a purpose that will be explained later.

Therefore, before the cargo warhead is fired, any translation of the slider is prohibited by the blocking means.

When the blocking means is retracted and the submunitions are no longer in the cargo warhead (in this case the slider cannot move to armed position since it is bearing on the cover of the shaped charge of the adjacent submunition), a limited translation of the slider is possible until it comes to rest in hollow 17 arranged in the slider on the collar 15, which thereby constitutes a second slider locking means.

The slider is then still immobilized in a safety position, but the collar 15 is removed from the groove 14, allowing translation of the striker.

The slider 8 carries a pin 38 (FIG. 3) that is pushed by a spring 39, arranged to engage in a hole 40 in the body 7 to ensure the locking of the slide in armed position.

Figure 6:
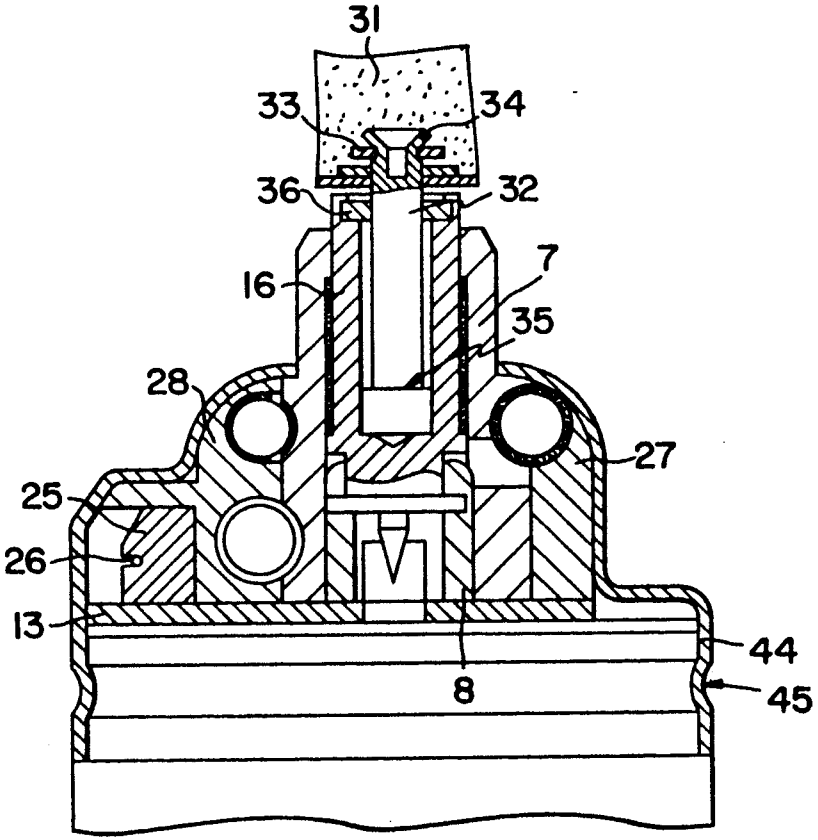
FIG. 6 is a section along plane C—C of FIG. 3.
Figure 5:
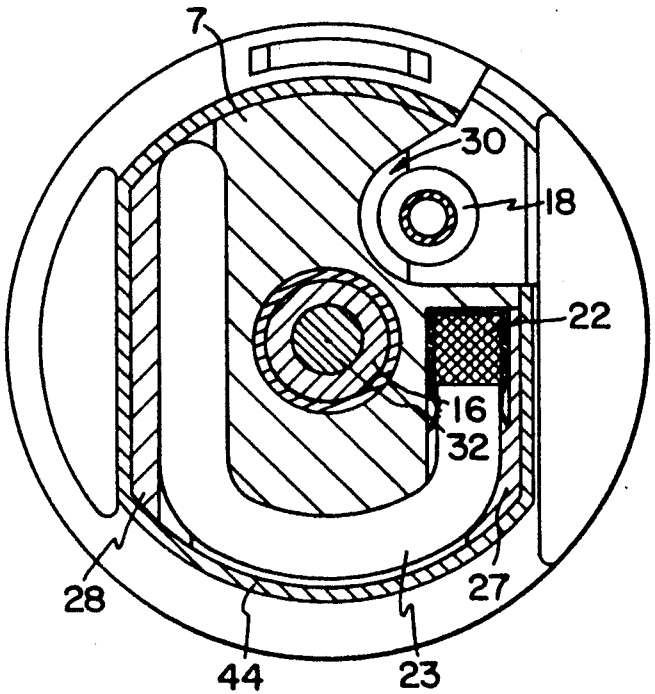
FIG. 5 is a section of the igniter system taken along the plane B—B of FIG. 2.

FIGS. 3, 5 and 6 show a self-destruct device including a striker 24 integral with the slider 8 and a delaying assembly consisting of a primer 21 and an igniter relay 22, crimped on a flexible delay wick 23.

The igniter device according to the invention also includes a neutralization means comprising a centrifugal trigger 25 held in the safety position shown in FIG. 3 by a torsion spring 26, and lodging its free end 51 between the striker 24 and the delay system primer 21, thereby constituting an obstacle preventing the slider from moving to its armed position. The trigger has a hollow 43 on its free and 51 opposite the striker 24, the purpose of which is explained hereafter.

The delaying assembly is fastened outside the body 7 by support pieces 27 and 28, secured to the body 8 by a click-on system that is not shown (see FIGS. 3, 5 and 6).

The device operates as follows.

When the shot is fired, an acceleration and a rotation are imparted to the warhead. By inertia, the flyweight 18 then compresses the spring 19 along the line Y—Y' and enters the opening 30. As the rotation of the projectile creates a centrifugal force, the flyweight 18 is offset and is trapped across the opening 30.

This offsetting is favored by the small diameter of the spring 19 and by the fact that the very short pin 20 offers practically no guidance. The slider 8 is no longer connected to the body by the flyweight 18 and can then slide slightly, within the limits established by the hollow 17 in the striker 16 and by the pressure of the slider on the cover of the neighboring submunition.

The flyweight 18, once offset, cannot subsequently return to its place, even once the acceleration phase is terminated.

It will be noticed that, as the opening 30 is free through 360° with respect to the line Y—Y' (see FIG. 5), the flyweight 18 will be trapped regardless of the orientation of the submunition in the warhead, no indexation between the submunition and the warhead is needed any more in the assembly, which simplifies the integration of the submunitions in the cargo warhead.

At the time of dumping, the submunitions are ejected from the warhead with a speed of rotation about their axis that is roughly equal to that of the warhead at the selfsame moment of dumping.

The centrifugal force causes the trigger 25 to pivot, and causes the translation of the slider 8, pushed by the spring 10. The collar 15 is then removed from the groove 14 and the striker is free to translate.

It should be noted that the striker 16 is not extracted instantaneously, but this occurs only once the tape 31 is deployed and the rod 32 has come out of its hollow (FIG. 7). This arming delay prevents two submunitions from operating accidentally if they hit each other at the time of dumping.

The tap 31 (FIG. 7) deploys and pulls out the telescoping rod 32, which butts against the washer 36, then extracts the striker 16 from its hollow 17.

The slider then goes to armed position and, at the same time, the striker 24 initiates the self-destruct device. The slider is locked by the pin 38 engaged in the hole 40.

The primer 9 is positioned by the peg 12, against which butts the end 37 of the hollow or spring 10.

During descent, the following occurs.

The attitude of the submunition is controlled by the tape 31, the effectiveness of which is reinforced by telescoping rod 32, which moves rearward the point of application of the braking force imparted by the tape 31, and increases the anti-flip torque.

The rotation of the submunition is braked by an aerodynamic device of known type, not illustrated (e.g. fins integral with the submunition body). The speed of rotation decreases and, with it, the centrifugal force retaining the trigger.

Upon impact, the submunition touches the target on the shaped charge side and is subjected to a very high deceleration at the same time. By inertia, the striker 16 strikes and initiates the primer 9, and thereby the shaped charge 4.

If, however, the fall of the submunition is gradually braked, e.g. by branches retaining the tape 31, the initiation of the charge is still ensured by the self-destruct device.

The primer 21 has lit the delay wick 23, which will initiate the primer 9 by means of the igniter relay 22, and through two openings 41 and 42 provided in the slider 8 and body 7, respectively (FIG. 7).

It will be noted that the self-destruct sequence starts at the time the igniter device reaches armed position, and continues thereafter, regardless of the environmental conditions encountered by the submunition during its freefall, which constitutes an assurance of reliability.

It will also be noted that this self-destruct arrangement can initiate the main charge only if the slider 8 is in armed position, as the opening 41 is then opposite the opening 42.

If it is not, as the primer 9 is disaligned, the operation of the relay 22 will have no consequences on the main charge, which is advantageous from the point of view of safety.

Moreover, if for any reason the slider 8 cannot slide and therefore the arming does not occur, the submunition would be on the ground, with all of the blocking means out of service, and any person handling it could then release the slider 8 and cause the percussion of the delay.

Such a disadvantageous is avoided thanks to the neutralization means proposed by the invention. That is, when the rotation of the submunition has stopped, the trigger 25, pushed by its spring 26, returns to the safety position shown in FIG. 3. It then limits the movements of the slider 8, preventing it from moving to armed position and initiating the delay.

It is possible to impart to the hollow 43 and to the trigger 25 a shape such that the return of the said trigger to the safety position is possible regardless of the intermediate position between the storage position and the armed position adopted by the primer-carrying slider.

The shape of the hollow 43 is complementary to that of the striker 24 so that, if the slider is displaced, bringing the striker inside the hollow 43, these elements are irreversibly trapped, which increases the safety of the device in later handling.

FIGS. 8 to 12 illustrate a second embodiment of the igniter device according to the invention, in which the elements analogous to those described above have the same item numbers.

In this particular embodiment, the body 7 is a foundry piece of zinc alloy (Zamac), manufactured for example by the lost wax process. As before, it includes a slider 8 arranged in a transverse groove in the body 7, and held by a closure disk 13 made integral with the body 7 by a means of attachment (screws or rivets) that are not illustrated.

The slider is pushed by the spring 10, which bears on one side on a peg 12 of the disk 13.

In this particular case, and for convenience of assembly, the spring 10 is arranged on a rod 52 so that the spring can be compressed in order to place it in its hollow. A split washer 53 is inserted between the spring 10 and the head of the rod 52 through an opening 54 in the disk 13. This washer therefore integrates the rod 52 with the slider 8.

The striker 16 is mounted sliding in the bore 49. In this variant, it includes no telescoping rod, but still carries the textile tape 31 fastened to the means by a washer 33 held by crimping 34.

The collar 15 of the striker 16 fits into the groove 14 of the slider 8, which thereby immobilizes the striker in translation.

A steel hoop 55 receives the igniter system and is made integral with it by transverse linking means (screws or rivets) that are not illustrated. This hoop is used to integrate the igniter system with the body of the charge (not illustrated here) by means of an annular crimping analogous to the crimping 45 illustrated in FIGS. 6 and 7.

The rotation braking fins 56 are folded on the hoop 55 and are welded to it by one of their ends.

In this particular embodiment, the locking of the slider in armed position is provided by a plunger 57 slidably mounted in a hollow 58 of the body 7 and pushed by a spring.

When the slider is in armed position, the peg 12 butts against the bottom of the hollow of spring 10, and the plunger enters hollow 17.

This plunger is held by a cover 59 of plastic material, which bears on a flat face of the body 7 and is made integral with it by rivets, not illustrated.

Figure 9:
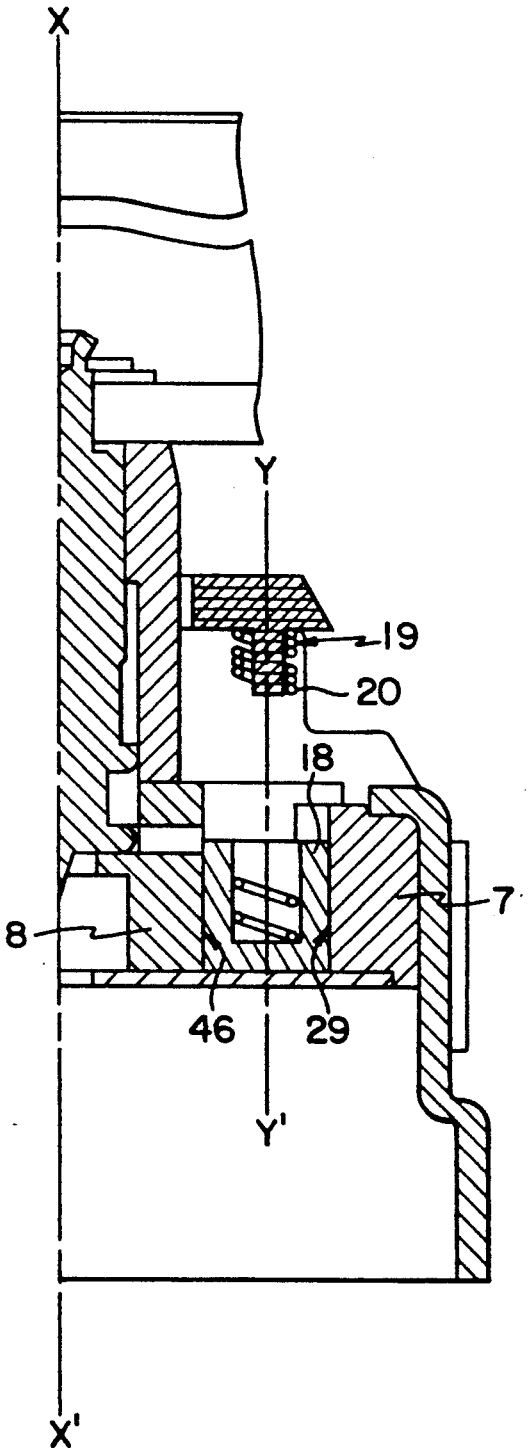
FIG. 9 is half-section of the device along plane F—F of FIG. 10, showing the acceleration safety.

The cover 59 also carries the pin 20, which guides the spring 19 of flyweight 18 (see FIG. 9). This flyweight constitutes the first blocking means of slider 8, as has already been described for the first embodiment.

Figure 10:
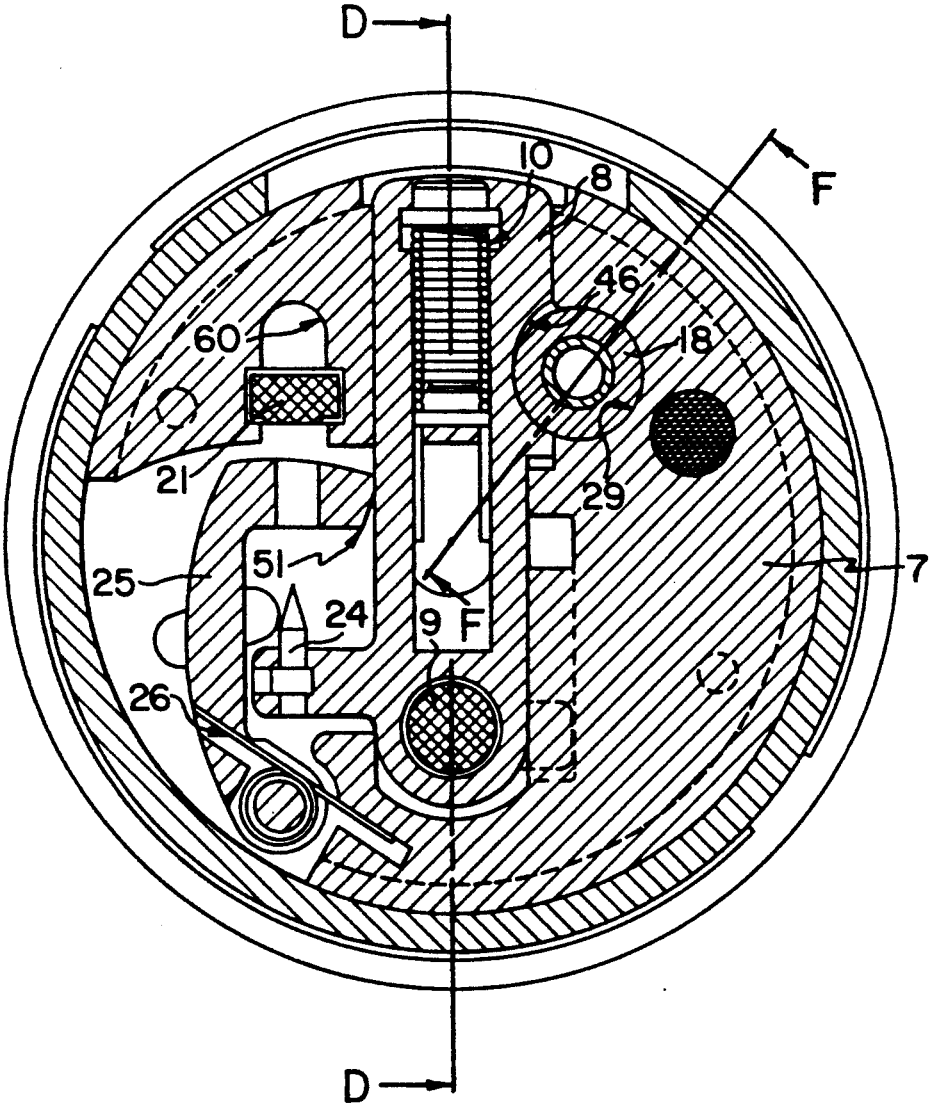
FIG. 10 is a cross section along plane G—G of FIG. 12.
Figure 11:
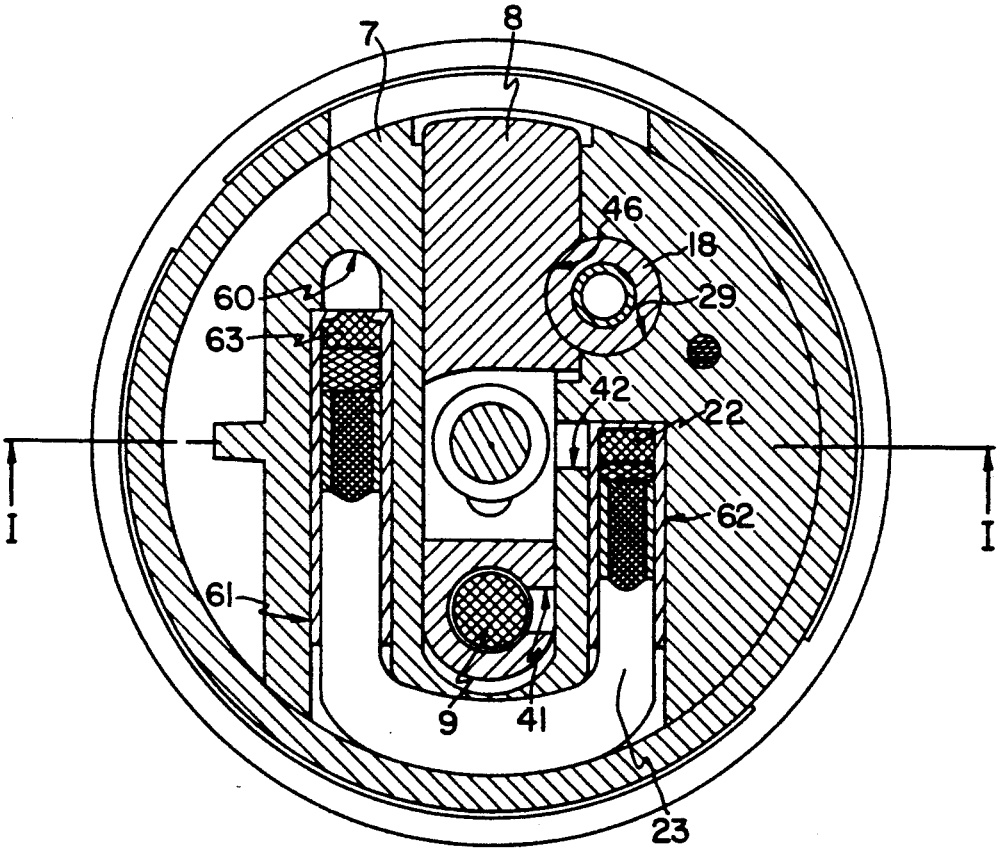
FIG. 11 is a section along the broken planes H—H of FIG. 12.
Figure 12:
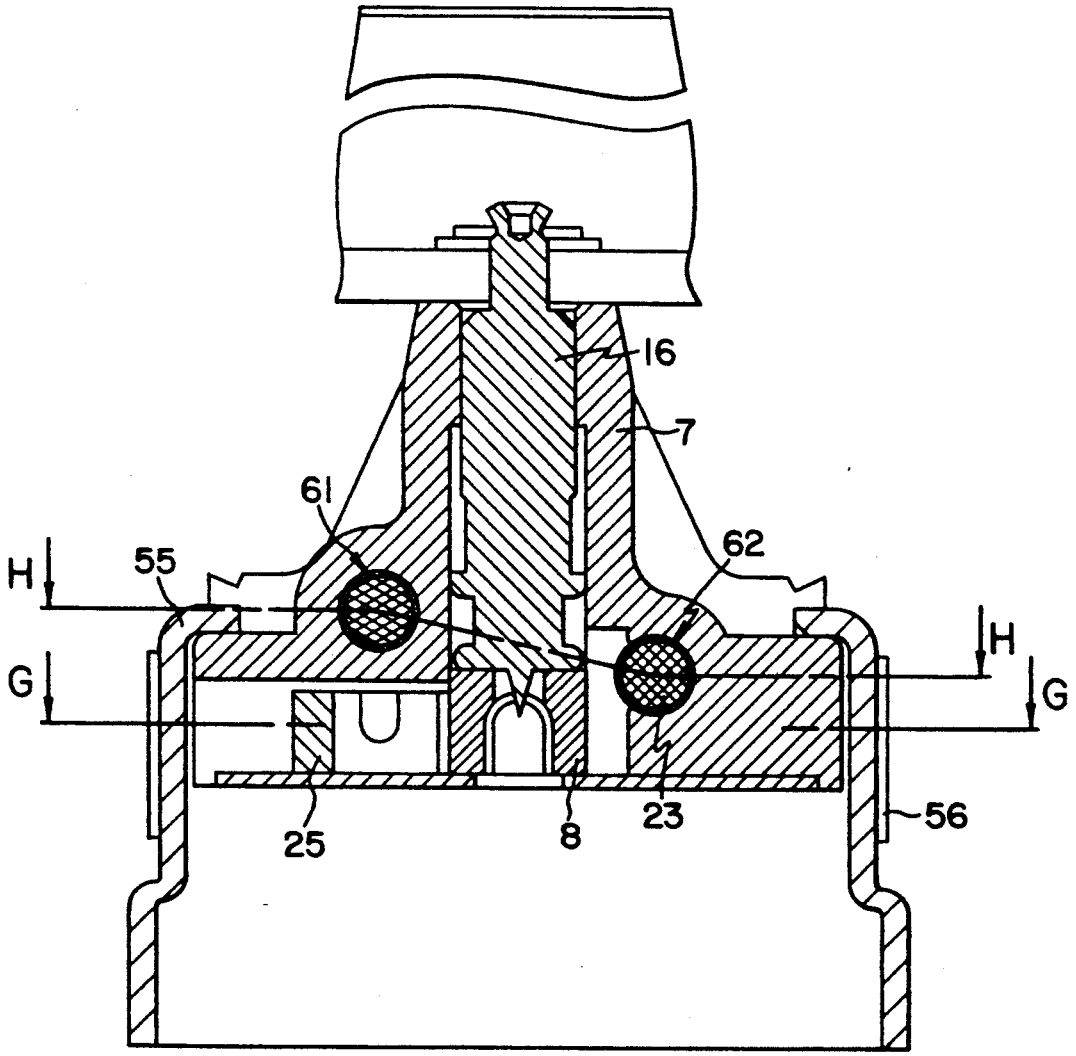
FIG. 12 is an axial section along plane I—I of FIG. 11.

FIGS. 10, 11 and 12 show the self-destruct device, which includes a striker 24 as before, integral with the slider 8, and a delay system consisting of a primer 21, an igniter relay 22 and a flexible delay wick 23 (see FIGS. 11 and 12).

In this particular embodiment, the primer is a percussion-sensitive inflammatory device that is not integral with the delay wick but which is fastened to the body 7 opposite the striker 24. A tube 60, arranged in the body 7, connects the inflammatory device to the delay wick 23.

Such an arrangement makes it possible to use a wick of reduced length and of a single curvature, which makes it easier to install on the body 7 by simple adjustment inside the parallel transverse bores 61 and 62, and guarantees the reliability of the transmission.

The flames produced by the initiation of the inflammatory device will be guided by the tube 60 and will initiate the delay wick 23 by means of a heat- or flame-sensitive ignition composition 63 such as a known mixture of zirconium and barium chromate.

The igniter relay 22 will initiate the primer 9 through the openings 41 (on the slider 8) and 42 (on the body), and will do so only if the slider 8 is in armed position (FIG. 11).

The neutralization means (FIG. 10) as before consists of the centrifugal trigger 25 held in the safety position by the torsion 26. In this particular embodiment, the trigger includes a hollow at its end, but this hollow does not have a form complementary to that of the striker 24, and therefore cannot trap this striker.

What we claim:

1. A pyrotechnic chain igniter device for cargo warhead submunition including an explosive charge contained in an enclosure, comprising:

a first striker mobile in a longitudinal bore of a body for striking a primer;

a slider carrying said primer, said slider being slidably mounted in a transverse groove in said body and being adapted for sliding between a safety position and an armed position, wherein said safety position is defined by said primer being misaligned with said first striker and said armed position is defined by said primer being substantially aligned with said first striker, and wherein said first striker is adapted for striking said primer when said slider is in said armed position and when said submunition impacts a target;

at least one means for blocking said slider in said safety position;

neutralization means comprising a trigger actuated by driving means for preventing said slider from sliding into said armed position; and delayed self-destruct means comprising a second primer, a delay wick, an igniter relay and a second striker, wherein said second striker is mounted on said slider for initiation of said second primer, said second primer being cooperable with said delay wick and igniter relay to initiate said primer.

2. The device of claim 1, wherein said second primer is a percussion-sensitive inflammatory device and said delay wick is connected to said inflammatory device by a tube.

3. The device of claim 1, wherein said self-destruct means further comprises two support pieces to fasten said self-destruct means to said body.

4. The device of claim 1, wherein said trigger comprises a hollow portion opposite said second striker, wherein said hollow portion has a complementary shape to that of said second striker, such that said second striker is trapped in said hollow portion after penetrating said hollow portion.

5. The device of claim 1, wherein said at least one means for blocking said slider comprises a flyweight disposed in a hollow of said body to prevent translation of said slider, a pin disposed on said body axially opposite said flyweight and a spring disposed between said pin and said flyweight, wherein said flyweight, said pin and said spring are axially disposed along a line parallel to a longitudinal axis of the submunition.

6. The device of claim 1, wherein said at least one means for blocking said slider comprises a collar integral with said first striker, wherein said collar cooperates with a complementary groove in said slider to prevent translation of said slider in said transverse groove, wherein aerodynamic forces exerted on a tape integral with said first striker causes translation of said first striker thereby releasing said slider.

7. The device of claim 1, wherein said first striker contains a rod having a free end with a tape disposed thereon and a shoulder opposite said free end, said rod at least partially disposed in an axial bore of said first striker, wherein forces exerted on said tape cause said rod to extend, and wherein said shoulder is adapted to cooperate with a washer disposed on said first striker to limit extension of said rod from said axial bore of said first striker.

8. The device of claim 1, further comprising a metal mask having an internal shape which corresponds to an external shape of said body, said metal mask being fastened to said enclosure by crimping said metal mask to a corresponding groove in said enclosure, said body being held in contact with said mask by a closure disk adjacent said explosive charge.

* * * * *